United States Patent [19]

Schmitz et al.

[11] 4,093,134

[45] June 6, 1978

[54] METHOD AND APPARATUS TO REDUCE WASTE YARN DURING TIE-UP OF YARN WINDERS

[75] Inventors: Alfons F. Schmitz; Douglas L. Dixon, both of Kingsport, Tenn.

[73] Assignee: Eastman Kodak Company, Rochester, N.Y.

[21] Appl. No.: 799,796

[22] Filed: May 23, 1977

[51] Int. Cl.[2] ..... B65H 54/02

[52] U.S. Cl. ..... 242/18 PW

[58] Field of Search ..... 242/18 PW, 18 A, 18 DD, 242/18 R, 25 A; 57/34 TT

[56] References Cited

U.S. PATENT DOCUMENTS

| | | | |
|---|---|---|---|
| 3,018,973 | 1/1962 | Bradley | 242/18 R |
| 3,034,736 | 5/1962 | Rhein, Jr. | 242/18 R |
| 3,777,996 | 12/1973 | Torii | 242/18 PW |
| 3,971,518 | 7/1976 | Newman et al. | 242/18 PW |

*Primary Examiner*—Stanley N. Gilreath

*Attorney, Agent, or Firm*—Malcolm G. Dunn; Daniel B. Reece, III

[57] ABSTRACT

Method and apparatus for practicing the method by which the loose end of yarn, which extends between the tube notch where the yarn becomes snagged and retained and the point in or near the air doffer where the yarn becomes snapped and severed, in the manner described in the Newman et al U.S. Pat. No. 3,971,518 and in the Spaller U.S. Pat. No. 3,999,716, is trapped and wound up on a pin projecting from the outer axial end of the winder mandrel, thus preventing any possible interference of the loose yarn end with the subsequent formation of a transfer tail on the yarn package tube and/or the winding of the package portion on the yarn package tube.

8 Claims, 2 Drawing Figures

METHOD AND APPARATUS TO REDUCE WASTE YARN DURING TIE-UP OF YARN WINDERS

BACKGROUND

This invention is directed to a yarn winder on which textile and industrial yarns are wound into packages, especially to a yarn winder having an apparatus for forming a transfer tail on a yarn package support or tube, which is rotating at high speeds; and particularly to an improvement in the winder and transfer tail apparatus disclosed in the Newman et al U.S. Pat. No. 3,971,518 and in the Spaller U.S. Pat. No. 3,999,716 and an improvement in the method disclosed therein.

Yarn winders having devices and apparatus for forming transfer tails on yarn package supports, particularly on yarn package supports that are rotating at the desired yarn package winding speeds, are well known in the art. Some of these prior art devices are represented by U.S. Pat. Nos. 3,276,704; 3,149,795; 3,224,692; and 3,575,355.

The textile winders concerned with this invention usually involve a yarn package support, which may be surface-driven, and where the traversing action for even distribution of the yarn on the yarn package support may be obtained by use of a drive roll having a spiral groove in its surface to traverse the yarn as it is wound on the package, as shown in U.S. Pat. No. 3,224,692. The traversing action may also be accomplished by the reciprocating motion of a yarn traverse guide through which the yarn advances to the yarn package support or tube, as in the case of U.S. Pat. No. 3,276,704 above, and U.S. Pat. No. 3,792,818.

The "transfer tail" is an initial wrap or turn or series of wraps or turns in the form of a single layer of a short length of helices at one end of the yarn package support or tube just outside the package portion of the tube. The purpose of the transfer tail is to facilitate the tying of the outer end of yarn from another yarn package to the transfer tail of the yarn package being processed or used in a textile mill so as to preserve the continuity of the operating process without having to shut equipment down when a yarn package becomes depleted.

The winder for which this invention, the transfer tail apparatus, is particularly adapted is the BARMAG SW4S Winder, Barmer Machinenfabrik, A. G., which winds yarn onto packages at speeds in excess of 3000 meters per minute. U.S. Pat. No. 3,792,818, which is mentioned above, appears to disclose a winder somewhat similar to the BARMAG winder.

A. NEWMAN ET AL PATENT

In the Newman et al patent, the transfer tail apparatus mounted on the yarn winder is adapted to form a transfer tail on the outer end portion of a rotating yarn package tube when the yarn is traveling at speeds in excess of 3000 meters per minute. The transfer tail apparatus is also capable of being used with yarn winders operating at slower speeds. The rotating yarn package tube is horizontally mounted on a yarn winder. The yarn winder has a self-threading yarn traverse guide, which is driven in reciprocation along a path that is parallelly spaced from the package portion of the yarn package tube and which guides the yarn onto the package portion of the tube. The yarn package tube has formed in its outer axial end an end slit or notch for snagging and retaining yarn. Other yarn snagging arrangements may also be provided in lieu of the end slit in the tube, such as an arrangement that is part of the tube or that is part of the mandrel on which the tube is mounted for rotation. It is only necessary that the snagging arrangement be at a location at the outer axial end of the tube where there is no interference with the surface drive of the yarn package tube or with the formation of any of the wraps on the tube. It is also necessary that the snagging arrangement be effective in enabling the yarn to commence winding on the yarn package tube.

The transfer tail apparatus of the Newman et al patent thus includes a yarn laying guide and a pigtail yarn guide, through each of which the continuously moving yarn is initially threaded by the operator by means of an air doffer in preparation for tie-up or connection of the yarn to the rotating yarn package support or tube. The yarn laying yarn guide and pigtail yarn guide are each adapted to be moved in a predetermined path, as in an arcuate path, from a first position to a latched second position; and upon release from the latched position, to be moved in return along the path to the first position. The movement of each of the two guides is powered and controlled by a spring arrangement, which is adjustable and is sufficiently large and steady as compared to the tension on the yarn and to any frictional changes in the system.

As the pigtail yarn guide is moved by the spring arrangement along the predetermined path in return to the first position from the latched position, the pigtail yarn guide translates the yarn into engagement with the outer axial end of the yarn package tube, whereupon the yarn becomes snagged and retained on the tube by the end slit when the end slit rotates clockwise (as viewed from the front of the apparatus) into the snagging position. In the instance of other yarn snagging arrangements located at the outer axial end of the yarn package tube, either as part of the tube or otherwise, the movement of the pigtail yarn guide would still bring the continuously moving yarn across at the outer axial end of the tube where the yarn snagging arrangement would be located. The yarn is then severed by snapping from the yarn continuing on to the air doffer as a result of the sudden increase in tension between the snagged yarn and the yarn passing into the air doffer. The yarn laying guide then guides the yarn onto the outer axial end of the rotating yarn package tube into a waste bunch of a predetermined number of wraps sufficient to assure retention of the yarn on the yarn package tube, after which the yarn laying guide is automatically released for movement in return to its first position. In the course of its return movement, the yarn laying guide is moved at such a rate relative to the rotation of the yarn package tube so as to form on the yarn package tube a transfer tail of a predetermined number of spaced wraps or helices, and then releases the yarn for subsequent pick up by the self-threading yarn traverse guide to thereafter wind yarn on the package portion of the yarn package tube.

The automatic release of the yarn laying guide from its latched position is preferably controlled by the pigtail yarn guide when it reaches a predetermined position along its path of return movement. Suitable mechanism linking the pigtail yarn guide with the yarn laying guide may be provided, such as a mechanically actuated or electrically actuated time delay mechanism, which may be triggered after a predetermined interval following release from the latched position of the pigtail yarn guide.

The yarn laying guide, as shown in the Newman et al patent, is generally U-shaped in configuration, has two spaced leg portions that are inclined upwardly and lie in planes extending above the axis of the yarn package tube and extend generally toward the yarn package tube when the yarn laying guide is in the latched second position. One of the leg portions is offset below and toward the other leg portion, and the other leg portion terminates in an L-shaped leg portion that lies above the first mentioned leg portion. The L-shaped leg portion is generally parallel with the yarn package tube and extends in a direction toward the outer axial end of the yarn package tube when the yarn laying guide is in the latched second position. The purpose of this construction is explained in the Newman et al patent.

When the yarn laying guide and the pigtail yarn guide are in their respective latched positions, the pigtail guide is then located in front of the outer axial end of the horizontally disposed yarn package tube; and the yarn laying guide is located at about the 10 o'clock position, relative to the location of the pigtail yarn guide and adjacent the outer axial end of the yarn package tube. The yarn, prior to tie-up, approaches the yarn winder from at least one godet roll above and axially inwardly to one side of the winder and passes over a pair of guide bars, which extend horizontally from the yarn winder a predetermined distance axially inwardly from the outer axial end of the yarn package tube and are positioned parallel to the yarn package tube. Then the yarn passes through the yarn laying guide, through the pigtail yarn guide and into a yarn waste receiver by means of an air doffer or other yarn aspirating device. When the pigtail yarn guide is released from its latched position by the operator, it translates the continuously moving yarn into engagement with the outer axial end of the rotating yarn package tube, and when the end slit on the tube, or other yarn snagging arrangement at the outer axial end of the tube, comes around in clockwise manner to about the 10 o'clock position on the tube, as viewed when standing in front of the outer axial tube end or relative to the location of the pigtail yarn guide, the snagging operation takes place. When the yarn is snagged, the sudden increase in tension on the yarn between the tube end slit or yarn snagging arrangement and the yarn passing into the yarn aspirating device or air doffer causes the yarn to snap or become severed. The yarn is then retained on the tube for subsequent winding thereon. Since the snagging operation takes place substantially in line with the path of approach of the yarn and also the final path of the yarn when the waste bunch commences to be formed, any tendency for any slack to occur in the yarn between the location of the snagging operation and the last godet roll above the winder is minimized.

When the yarn is finally released from the yarn laying guide for subsequent pick up by the self-threading yarn traverse guide, the tension on the yarn from above and axially inwardly of the yarn package tube causes the yarn to continue to be moved axially inwardly a short distance along the pair of horizontally extending guide bars and then into the self-threading yarn traverse guide.

The preceding description describes the character and operation of the transfer tail apparatus in the Newman et al patent, and the transfer tail in the instant invention is formed in essentially the same manner with some slight modification, as will be described herein.

B. SPALLER PATENT

In the Spaller patent, a single cocking mechanism is provided that is readily visible and accessible to the operator and that serves to cock or move the yarn laying guide and the pigtail yarn guide at essentially the same time to the latched second position, preparatory to the transfer tail formation, without the operator bringing his hands near any high speed moving parts on the yarn winder.

It also provides for the yarn laying guide a limited back travel arrangement, which will be effective prior to the time of the formation of the transfer tail so as to provide tying wraps from one side to the other and in return, or in other words, across the waste bunch, so as to minimize the risk of the waste bunch accidently coming off the yarn tube and hence pulling with it the formed transfer tail.

The Spaller transfer tail apparatus otherwise operates in essentially the same manner as that of the Newman et al apparatus, and the transfer tail in the instant invention is formed essentially in the same manner with some slight modification, as heretofore indicated and as will be described herein.

C. THIS INVENTION

From time to time in the operation of the transfer tail apparatus of the above described Newman et al and Spaller patents, it was observed that yarn in the transfer tail waste bunch would be damaged and torn up due to yarn contact with the winder drive roll step on the BARMAG winder. Occasionally, the yarn would pull out of the notch in the outer axial end of the yarn package support or tube. The loose end would be pulled into the package creating a wound-in-waste condition. In either event, the yarn would have a fuzzy appearance at one end of the package and the appearance of the yarn package would be marred.

Further observation revealed that at the time the yarn was snagged by the tube notch, the yarn would snap and sever either close to the air doffer or within the air doffer itself, often leaving a loose end about 36 inches long, depending upon how far from the apparatus the operator held the air doffer at the time of the transfer tail operation. Such a length of loose yarn will whip around in the air and be pulled into the yarn package or into the path of the step on the winder roll and create the condition described. Also, pieces of the yarn would break free and either be thrown into the package or elsewhere.

It is an object of the invention to reduce significantly the loose waste created at time of tie-up of the yarn to the yarn package tube and thereby improve the quality of appearance of the yarn package by eliminating fused and chewed-up yarn ends.

SUMMARY OF THE INVENTION

The invention involves adding to the yarn winder mandrel at its outer axial end at and concentric with its axis a pin, which projects to a predetermined extent outwardly from the mandrel outer axial end and which rotates with the winder mandrel. When the yarn becomes snagged in the notch or end slit on the yarn package tube and the yarn subsequently becomes severed in or near the air doffer, in the manner described above, the projecting pin at that time becomes operative for trapping the loose portion of the severed yarn that extends between the notch or end slit and the point of severment. The pin, as it rotates with the winder mandrel, thus winds up the loose portion of the yarn, and as it is doing so, maintains a tension on the yarn snagged in the notch or end slit that serves to hold the yarn firmly in the notch and to prevent the yarn from accidentally pulling out of the notch or end slit. When the yarn package is ready to be removed from the mandrel, the operator cuts the yarn at a point between the notch and the projecting pin and removes the wrapped layers of yarn from around the pin by easily slipping them off and discarding them, before removing the yarn package tube from the mandrel.

Slack in the yarn at the time of tie-up of the yarn to the yarn package sometimes will cause what is known as a "roll wrap" on the godet roll preceding the yarn winder. When the slack occurs, the filaments may momentarily separate or fan out from the main body of the yarn. Any filaments breaking and/or otherwise adhering to the godet roll will become wrapped around the godet roll, causing other yarn following the filaments to become similarly wrapped. With the yarn moving at a high speed, it takes only a moment or so for the godet roll to be wrapped with yarn and result in a breakdown in the yarn process.

It was recently observed in the Newman et al and Spaller patented apparatus that, at the time the yarn became snagged by the tube notch or slit, a slight slack in the yarn would sometimes occur momentarily at the godet roll immediately preceding the yarn winder. Such slight slack did not appear to be sufficient under normal circumstances, however, to cause the yarn undesirably to wrap the godet roll. The reason that no wrap occured is thought to be due to the fact that the slight slack only happened over a short arcuate distance of the godet roll; whereas in similar situations resulting in roll wraps, the slack was of sufficient extent to cause the fanning of filaments to extend over a greater arcuate distance of the godet roll.

The present invention appears to have further minimized, if not eliminated, the possibility of any slack occurring, and it is now theorized that what may have happened in the Newman et al and Spaller patented apparatus is that at the time the yarn was snagged in the tube notch and subsequently severed, a slight slippage of the yarn through the tube notch may have resulted and thus caused the momentary slight slack observed. In the present invention, when the loose end of yarn is being wound on the projecting pin, such action prevents any slippage of the yarn in the tube notch.

The above-described manner of trapping and winding the loose portion of yarn may be facilitated by making some slight modification to the transfer tail apparatus, and thereby eliminate the necessity that the operator hold the air doffer in a particular position so that the yarn will pass under the projecting pin before the yarn becomes snagged and severed.

The previously described movable pigtail yarn guide, which translates the yarn into engagement with the outer axial end of the yarn package tube, may be changed so that the pigtail portion of the guide becomes a vertically downwardly projecting pin guide having along its length an arcuate bend, or any other means, which serves to restrain the yarn from slipping free from the pin guide until the pin guide has guided the yarn to a position for subsequent release beneath the projecting pin on the winder mandrel.

An auxiliary guide may then be added to the rear of the winder in a predetermined fixed position and provided with a pigtail portion so that when the yarn is initially threaded up by the operator, the yarn passes first through the above-described yarn laying guide; secondly around the vertically downwardly projecting pin guide within the arcuate bend in the pin guide surface; and thirdly through the fixed pigtail auxiliary guide at the rear of the winder before passing into the air doffer. In this manner, the yarn initially follows two legs of a triangular path through the three yarn guides, with the first (yarn laying guide) and third (auxiliary fixed pigtail guide) guides subsequently defining therebetween the third leg of the triangle. The latter or third leg of the triangle extends in an essentially straight line path, except for enabling the yarn, when allowed to follow the third leg, to bend around or deflect slightly from the straight line path, across the outer edge of the outer axial end of the package tube for subsequent snagging by the notch in the outer edge. The third leg of the triangle also causes the yarn, when allowed to follow the third leg, to follow a path extending under the projecting pin on the winder mandrel.

The movable pin guide in its latched position or latched second position, as described in the Newman et al and Spaller patents, serves to keep the yarn from contacting the yarn package tube. Then, when the movable pin guide is triggered into action, the pin guide moves inwardly toward the projecting pin along a path during which the yarn becomes released from the aforedescribed arcuate bend of the pin guide and becomes free to follow the essentially straight line path, as defined by the third leg of the triangle. The moving yarn thus not only comes into engagement with the outer axial end of the yarn package tube for subsequent snagging and severing, as heretofore described, but also passes along a path extending beneath the projecting pin on the winder mandrel.

The air doffer serves to maintain tension on the moving yarn so that when the yarn becomes released from the movable pin guide, the yarn will literally snap into the path defined by the third leg of the triangle and positively against the outer edge of the outer axial end of the yarn package tube.

Since the moving yarn has been caused to follow along a path extending under the projecting pin on the winder mandrel, the tube notch or slit will snag the yarn at about the 9 o'clock position of tube rotation, as viewed from the outer axial end of the yarn package tube, instead of about the 10 o'clock position, which was described in the Newman et al and Spaller patents.

It should be understood that the addition of the auxiliary guide is optional. Its function of establishing one point of the aforementioned triangular path could be achieved by the operator holding the air doffer at such position relative to the winder to cause the yarn, when released by the movable pin guide or movable pigtail guide (as called in the Newman et al and Spaller patents), to follow the aforedescribed "essentially straight line path". The auxiliary guide is useful, however, in eliminating possible misjudgment on the part of the operator as to the position where the operator thinks he is holding the air doffer.

The invention also involves an improved method over that inherent in the disclosures in the aforementioned Newman et al and Spaller patents, whereby the loose end of yarn, which extends between the point where the yarn has become snagged and retained by the outer axial end of the rotating yarn package tube and the point in or near the air doffer where the yarn has become snapped and severed, is trapped away from the yarn package tube so that it does not possibly interfere with the subsequent formation of a transfer tail and/or winding of the yarn on the package portion of the yarn package tube.

DESCRIPTION OF THE PREFERRED EMBODIMENT

Figure 1:
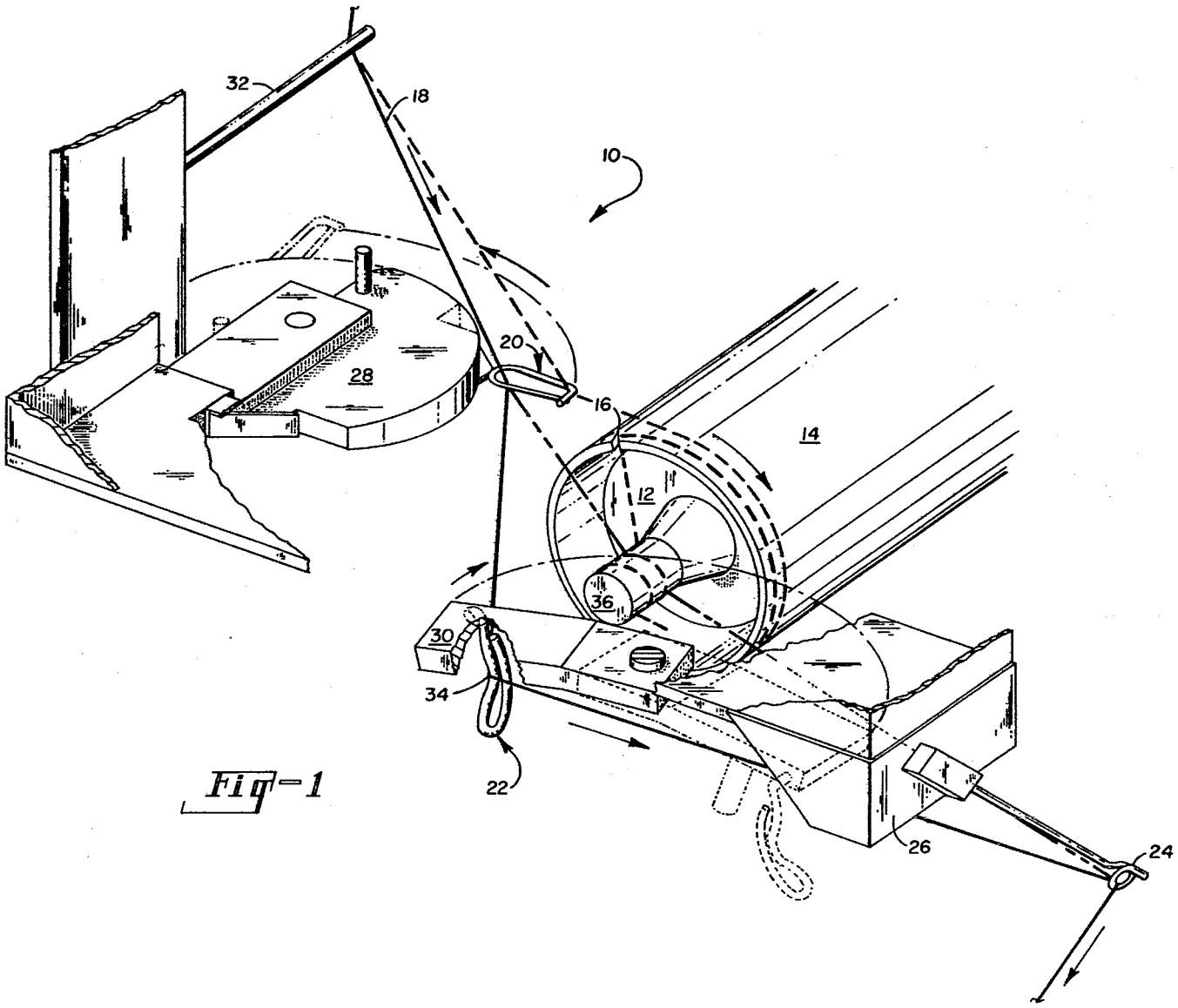
FIG. 1 is an isometric view of a portion of the yarn winder and its transfer tail apparatus with parts broken away, showing the outer axial end of the winder mandrel and its axially projecting pin, and illustrating (a) in solid lines the path of the yarn through the yarn guides prior to actuating the transfer tail apparatus, and (b) in phantom lines the path of the yarn below the projecting pin as the pin guide swings out of contact with the yarn, and (c) in phantom lines the loose end of severed yarn having been wound on the projecting pin firmly holding the yarn in the tube notch where it is snagged.

In reference to the drawings, the yarn winder 10 is shown only in part in FIG. 1. Reference may be made for a more detailed illustration of the yarn winder in Newman et al U.S. Pat. No. 3,971,518 and the Spaller U.S. Pat. No. 3,999,716.

The yarn winder has a rotatable mandrel 12, the outer axial end of the mandrel being illustrated in FIG. 1. A yarn package tube 14 is shown supported upon the winder mandrel and has in its outer axial end a notch or slit 16 for snagging the yarn 18 in preparation for forming a transfer tail on the yarn package tube.

The yarn winder also has attached to it a transfer tail apparatus, only a portion of which is illustrated in the drawings, since reference may also be made to the above-mentioned Newman et al and Spaller patents for a more detail illustration. For purposes of this description, however, the transfer tail apparatus includes the movable yarn laying guide 20 and the movable pin guide 22. An auxiliary pigtail guide 24 may be fixedly added to the yarn winder and attached to the winder housing, shown only in part at 26. The yarn laying guide 20 is attached to a pivotal holder 28, while the pin guide is attached to a swingable holder 30, in the manner illustrated.

The yarn 18 approaches the yarn winder from above, as from a source of supply (not shown). When the operator threads up the transfer tail apparatus in preparation for (1) connecting the yarn to the yarn package tube, (2) forming the yarn transfer tail on the package tube and (3) winding the yarn package, the operator by means of an air doffer (not shown) guides the yarn past and under the guide bar 32, which is attached at one end of the winder and is positioned parallel to the winder mandrel, and then threads the yarn through the yarn laying guide 20, guides the yarn around the pin guide 22 so that the yarn rides in the arcuate bend 34 in the pin guide, and finally threads the yarn through the fixed pigtail guide 24, which is located at the rear of the yarn winder on the opposite side from where the yarn laying guide is located. The positions shown occupied by the yarn laying guide 20 and the pin guide in solid line position in FIG. 1 are the latched second positions to which the operator has moved them, as described in the aforementioned Newman et al and Spaller patents, once the operator has completed the threading-up operation.

Figure 2:
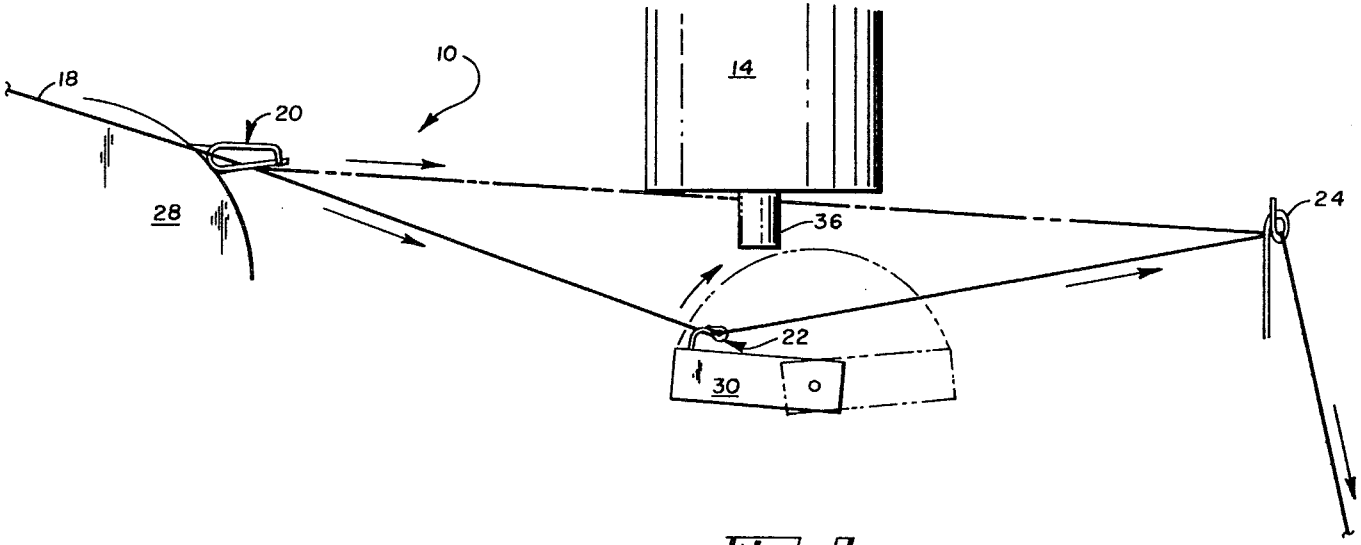
FIG. 2 is a plan view of a portion of the yarn winder illustrating (a) in solid lines the triangular path followed through the yarn guides by the yarn at time of thread-up by the operator and (b) in phantom lines the straight line path past and under the projecting pin followed by the yarn prior to its becoming severed and wound-up on the projecting pin.

The yarn, which is continuously moving, thus passes from a sourch of supply, past and through the aforementioned guides and into the air doffer (not shown). As shown in FIG. 2, the yarn initially follows along an angular path, or two legs of a triangle, as illustrated in solid lines.

In operation, the operator then actuates the release of the pin guide 22 and the yarn laying guide 20, in the manner described in the aforementioned Newman et al and Spaller patented apparatus. The continuously moving yarn 18, which moves along a path to and past the outer axial end of the yarn package tube 14, is guided or translated into engagement with the outer axial end of the yarn package tube by the pin guide as it swings or pivots from its latched second position in return to its first position along the path illustrated in phantom line. The term "latched second position" and "first position" are the terms identified and employed in the aforesaid Newman et al and Spaller patents.

The moving pin guide 22 in its latched second position initially keeps the yarn 18 out of contact with the package tube, as previously mentioned. Then when the pin guide is released for swinging in the arcuate path illustrated, it brings the yarn to an area below and adjacent to the pin 36, which projects axially outwardly from the outer axial end of the winder mandrel. The pin 36 is concentric with the axis of the winder mandrel and rotates with the winder mandrel. When the pin guide passes its closest approach to the projecting pin the yarn slips free and, because of the tension on the yarn by the air doffer, as previously described, the yarn snaps into the essentially straight line path between the yarn laying guide 20 and the auxiliary pigtail guide 24, allowing for a slight bending around or across the outer edge of the yarn package tube, as shown in FIG. 2.

The continuously moving yarn 18 is now riding against the outer edge of the outer axial end of the rotating package tube 14 and follows along an essentially straight line path or along the path of the third leg of the aforementioned triangle; and the swinging or pivoting pin guide 22 has moved free of guiding engagement with the moving yarn. As the pin guide continues its swinging or pivoting movement, it subsequently causes the yarn laying guide to be released from its "latched second position" for return to its "first position" and subsequent release of the yarn to a yarn traverse guide (not shown), all in the manner described more fully in the aforementioned Newman et al and Spaller patents.

Before the actuation of the yarn laying guide 20, however, the notch or slit 16 in the outer axial edge of the yarn tube rotates (clockwise, as viewed from the outer axial end of the yarn package tube) to about the 9 o'clock position where it catches or snags the moving yarn riding against the outer axial end of the tube. The snagged yarn is retained in the notch and as the tube continues its clockwise rotation it starts to rotate away from the path the yarn is following into the air doffer, and the resulting change of direction increases tension in the yarn in or near the air doffer to the extent that causes the yarn to snap apart and thus become severed.

The clockwise rotation of the tube notch or slit 16 also carries a portion of the yarn in a clockwise direction from under, around and over the projecting pin 36 on the winder mandrel. Upon the yarn becoming snagged and severed, the projecting pin, as it rotates with the winder mandrel, traps the loose end of the yarn extending between the point where the yarn has become snagged and the point where the yarn has become severed, and winds up the loose yarn end. The winding of the loose yarn end causes the yarn to be tightly held in the tube notch, thereby preventing it from being accidentally pulled out before desired. Also, as previously mentioned, the maintenance of tension on the yarn snagged in the notch prevents the possibility of any yarn slippage through the notch, thereby further minimizing, if not eliminating, slack in the yarn at the preceding godet roll (not shown).

When the operator is ready to doff a completed yarn package, the operator merely cuts the yarn at a location extending between the projecting pin 36 and the tube notch, slips the wound layers from the projecting pin and disposes of them, and then removes the yarn package from the mandrel.

The invention has been described in detail with particular reference to preferred embodiments thereof, but it will be understood that variations and modifications can be effected within the spirit and scope of the invention.

We claim:

1. In a yarn winder having a mandrel for rotatably supporting a yarn package tube that has in the outer axial end of the yarn package tube a notch for snagging a yarn moving from a source of supply and into an air doffer, and a transfer tail apparatus for guiding the moving yarn into engagement with the outer axial end of a rotating supported yarn package tube for subsequent snagging of the yarn by the notch and severing of the yarn between the notch and in or near the air doffer and subsequent formation on the yarn package tube of a yarn transfer tail prior to release of the moving yarn from the transfer tail apparatus to a yarn traverse guide on the yarn winder for guiding of the yarn onto the package portion of the yarn package tube as the yarn package tube rotates, the improvement comprising:

means on the mandrel operative upon the yarn becoming snagged in the notch and severed for trapping the loose portion of the severed yarn that extends between the notch where the moving yarn becomes snagged and a point in or near the air doffer where the yarn becomes severed.

2. In a yarn winder as defined in claim 1, wherein the means on the mandrel winds up said loose portion of yarn.

3. In a yarn winder as defined in claim 1, wherein the means on the mandrel comprises a pin attached to and projecting a predetermined distance from the outer axial end of the mandrel beyond the outer axial end of the supported yarn package tube.

4. In a yarn winder as defined in claim 3, wherein the projecting, attached pin is concentric with the axis of the mandrel.

5. In the method of forming a transfer tail on a yarn package tube mounted on a rotating mandrel in a yarn winder, wherein prior to forming the transfer tail the yarn is moving from a source of supply to and past the outer axial end of the yarn package tube as it is rotated by the mandrel and into an air doffer to be conveyed away, with the moving yarn subsequently being guided into engagement with the outer axial end of the rotating package tube and snagged and retained by the outer axial end, followed by snapping and severing of the yarn from the yarn being conveyed away by the air doffer, the improved method comprising:

trapping away from the yarn package tube the loose end of yarn extending between the point where the yarn has become snagged and retained by the outer axial end of the rotating yarn package tube and the point in or near the air doffer where the yarn has become snapped and severed.

6. In the improved method defined in claim 5, wherein trapping the loose end of yarn includes winding up the loose yarn end.

7. In the improved method defined in claim 6, wherein the loose yarn end is wound up by the yarn winder at a location away from the yarn package tube.

8. In the improved method defined in claim 7, wherein the loose end of yarn is wound up on a portion of the rotating mandrel projecting beyond the outer axial end of the yarn package tube.

* * * * *